US009343228B2

(12) United States Patent
Park

(10) Patent No.: US 9,343,228 B2
(45) Date of Patent: May 17, 2016

(54) LAMINATED INDUCTOR AND MANUFACTURING METHOD THEREOF

(71) Applicant: SAMSUNG ELECTRO-MECHANICS CO., LTD., Suwon-Si, Gyeonggi-do (KR)

(72) Inventor: Yong Sun Park, Suwon-Si (KR)

(73) Assignee: SAMSUNG ELECTRO-MECHANICS CO., LTD., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/254,590

(22) Filed: Apr. 16, 2014

(65) Prior Publication Data

US 2015/0102887 A1 Apr. 16, 2015

(30) Foreign Application Priority Data

Oct. 11, 2013 (KR) ..... 10-2013-0121226

(51) Int. Cl.

| | |
|---|---|
| ***H01F 5/00*** | (2006.01) |
| ***H01F 27/28*** | (2006.01) |
| ***H01F 21/02*** | (2006.01) |
| ***H01F 41/04*** | (2006.01) |
| ***H01F 17/00*** | (2006.01) |

(52) U.S. Cl.

CPC ..... *H01F 41/041* (2013.01); *H01F 17/0013* (2013.01); *H01F 2017/0073* (2013.01); *Y10T 29/4902* (2015.01)

(58) Field of Classification Search

CPC ..... H01F 17/0006; H01F 17/0013; H01F 27/2804; H01F 41/041; H01F 2027/2809

USPC ..... 336/200, 223, 220, 147, 222

See application file for complete search history.

(56) References Cited

U.S. PATENT DOCUMENTS

| | | | | |
|---|---|---|---|---|
| 6,380,835 | B1 | 4/2002 | Lee | |
| 2003/0222750 | A1 * | 12/2003 | Kyriazidou | 336/200 |
| 2004/0130415 | A1 * | 7/2004 | Chiba et al. | 333/185 |
| 2006/0014303 | A1 * | 1/2006 | Takazawa | 438/1 |
| 2008/0272875 | A1 * | 11/2008 | Huang | H01F 17/0013 336/182 |
| 2011/0050380 | A1 * | 3/2011 | Nakanishi | H01F 27/341 336/200 |
| 2011/0102121 | A1 * | 5/2011 | Otsuka | H01F 27/06 336/192 |
| 2011/0133877 | A1 * | 6/2011 | Chiu et al. | 336/200 |

FOREIGN PATENT DOCUMENTS

| | | |
|---|---|---|
| JP | 08-162327 A | 6/1996 |
| JP | 2002-043130 | 2/2002 |

(Continued)

OTHER PUBLICATIONS

Japanese Office Action dated Sep. 1, 2015 issued in Japanese Patent Application No. 2014-077019.

(Continued)

*Primary Examiner* — Mangtin Lian

(74) *Attorney, Agent, or Firm* — McDermott Will & Emery LLP

(57) ABSTRACT

A laminated inductor may include a body having a plurality of ceramic layers stacked therein, a plurality of conductive patterns formed on the ceramic layers, and via electrodes disposed between the ceramic layers and connecting the conductive patterns disposed in a vertical direction to form a coil. Each of the conductive patterns may include a plurality of unit patterns disposed in parallel to be spaced apart from each other on each of the ceramic layers.

4 Claims, 8 Drawing Sheets

(56) References Cited

FOREIGN PATENT DOCUMENTS

| | | | |
|---|---|---|---|
| JP | 2003-141930 | A | 5/2003 |
| JP | 2005-150137 | A | 6/2005 |
| KR | 2001-0011350 | A | 2/2001 |
| WO | 2010/092861 | A1 | 8/2010 |

OTHER PUBLICATIONS

Japanese Office Action dated Mar. 22, 2016 issued in Japanese Patent Application No. 2014-077019 (English translation).

* cited by examiner

LAMINATED INDUCTOR AND MANUFACTURING METHOD THEREOF

CROSS-REFERENCE TO RELATED APPLICATION

This application claims the benefit of Korean Patent Application No. 10-2013-0121226 filed on Oct. 11, 2013, with the Korean Intellectual Property Office, the disclosure of which is incorporated herein by reference.

BACKGROUND

The present disclosure relates to a laminated inductor and a manufacturing method thereof.

An inductor, a main passive element constituting an electronic circuit together with a resistor and a capacitor, is used in a component, or the like, removing noise or constituting an LC resonance circuit.

The inductor may be classified as one of various types thereof, such as a wire wound type inductor, a thin film type inductor, a laminated inductor, and the like.

The wire wound type inductor or thin film inductor may be manufactured by winding a coil around a ceramic core, plating the core with a thin film, or performing photolithography, and forming electrodes at both ends thereof.

The laminated inductor may be manufactured by forming a conductive pattern on a plurality of sheets formed of a ceramic material such as a magnetic material, dielectric material, or the like, through photolithography or printing, and subsequently stacking the plurality of sheets in a thickness direction.

In particular, the laminated inductor has advantages such as miniaturization and slimness and is also advantageous in terms of direct current (DC) resistance, compared to a wire wound type inductor, and thus, the laminated inductor may be widely used in small power circuits, or the like, requiring high current.

The laminated inductor is manufactured by forming a conductive pattern on ceramic sheets through photolithography or printing, and vertically stacking the sheets, and in this case, parasitic capacitance and resistance, as well as inductance, are also provided to degrade inductance.

Meanwhile, a quality factor (Q factor) is based on correlation among inductance, parasitic capacitance, and resistance of the laminated inductor.

In general, when the Q factor is increased, the number of lamination of the laminated inductor may be reduced or a degree of freedom in design according to a space disposition may be increased.

Thus, recently, as electronic products have increasingly used in high frequency bands and consumed a large amount of power, research into laminated inductors having high Q factor have been actively conducted.

SUMMARY

An aspect of the present disclosure may provide a laminated inductor having improved inductance, Q factor, and SRF with the same core area.

According to an aspect of the present disclosure, a laminated inductor may include: a body having a plurality of ceramic layers stacked in the body; a plurality of conductive patterns disposed on the ceramic layers; and via electrodes disposed on the ceramic layers and connecting the conductive patterns disposed in a vertical direction to form a coil, wherein each of the conductive patterns includes a plurality of unit patterns disposed in parallel to be spaced apart from each other on each of the ceramic layers.

The conductive patterns may have a shape corresponding to a half of a loop, a shape corresponding to three-quarters of a loop, a shape corresponding to five-sixths of a loop, or a shape close to that of a loop.

The conductive patterns may include first and second connection patterns led out to both end surfaces of the ceramic body.

The laminated inductor may further include: first and second external electrodes disposed on both end surfaces of the body and connected to the first and second connection patterns, respectively.

The laminated inductor may further include upper and lower cover layers stacked on upper and lower portions of the body.

According to another aspect of the present disclosure, a manufacturing method of a laminated inductor may include: preparing a plurality of ceramic sheets; forming via electrodes in the respective ceramic sheets; forming conductive patterns on each of the ceramic sheets; stacking and pressurizing the ceramic sheets to form a laminate in such a manner that the via electrodes and the conductive patterns disposed in a vertical direction are in contact with one another to form a single coil; sintering the laminate to form a body; and forming first and second external electrodes on both end surfaces of the body, wherein each of the conductive patterns is formed of a plurality of unit patterns disposed in parallel to be spaced apart from each other on each of the ceramic layers, and includes first and second connection patterns led out to the both end surfaces of the body to be connected to the first and second external electrodes, respectively.

In the forming of the conductive patterns, the conductive patterns may be formed on the ceramic sheets through a thin film plating method, an exposure method of a photosensitive paste, or a printing method of a conductive paste.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
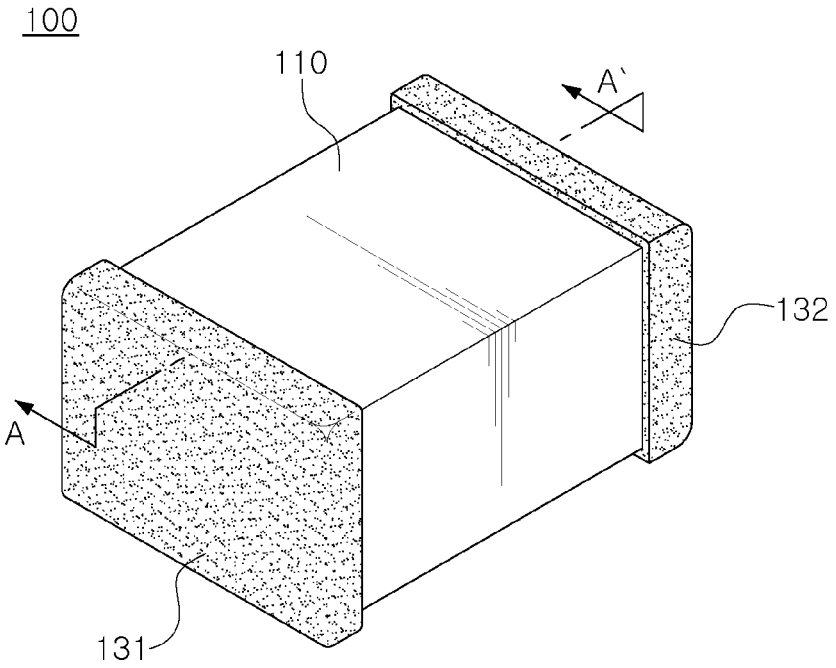
FIG. 1 is a perspective view illustrating a laminated inductor according to an exemplary embodiment of the present disclosure.

Exemplary embodiments of the present disclosure will now be described in detail with reference to the accompanying drawings.

The disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

In the drawings, the shapes and dimensions of elements may be exaggerated for clarity, and the same reference numerals will be used throughout to designate the same or like elements.

In the present exemplary embodiment, surfaces on which first and second external electrodes are formed in a length direction of a body will be set as both end surfaces of the body, surfaces connected to the both end surfaces to be perpendicular thereto will be set as both side surfaces of the body, and surfaces of the body in a thickness direction will be set as upper and lower surfaces of the body for the description purposes.

Figure 2:
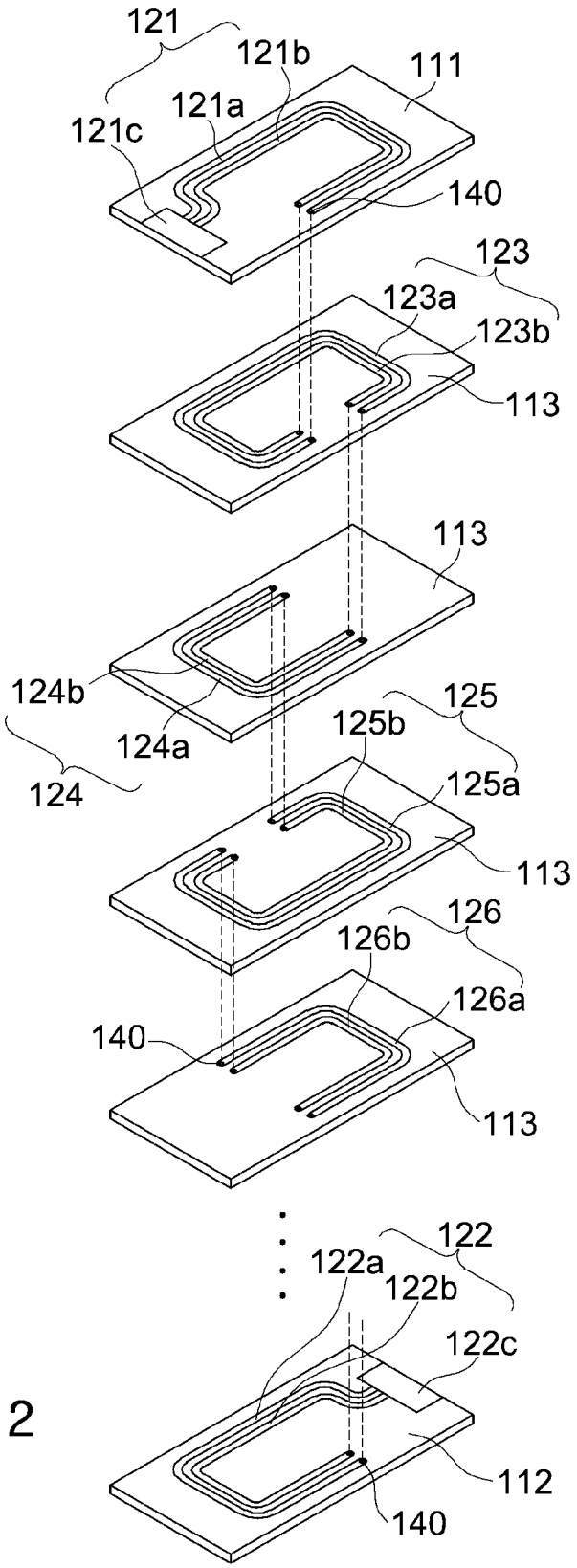
FIG. 2 is an exploded perspective view illustrating a layout structure of conductive patterns and via electrodes of the laminated inductor according to an exemplary embodiment of the present disclosure.

FIG. 1 is a perspective view illustrating a laminated inductor according to an exemplary embodiment of the present disclosure, and FIG. 2 is an exploded perspective view illustrating a layout structure of conductive patterns and via electrodes of the laminated inductor according to an exemplary embodiment of the present disclosure.

Referring to FIGS. 1 and 2, a laminated inductor 100 according to an exemplary embodiment of the present disclosure includes a ceramic body 110, a plurality of conductive patterns 121, 122, 123, 124, 125, and 126, and a plurality of via electrodes 140 connecting the conductive patterns 121, 122, 123, 124, 125, and 126 disposed in a vertical direction to form a coil.

Each of the conductive patterns 121, 122, 123, 124, 125, and 126 include a plurality of unit patterns disposed in parallel to be spaced apart from each other on a single ceramic layer including a magnetic material, a dielectric material, or the like. This will be described in detail hereinafter.

First and second external electrodes 131 and 132 may be formed on both end surfaces of the ceramic body 110.

Upper and lower cover layers (not shown) may be further formed on upper and lower surfaces of the ceramic body 110 in order to protect the plurality of conductive patterns 121, 122, 123, 124, 125, and 126 printed within the ceramic body 110.

The upper and lower cover layers may be formed by stacking a single ceramic layer or plurality of ceramic layers formed of ceramic sheets in the thickness direction.

The ceramic body 110 may be formed by stacking a plurality of ceramic layers 111, 112, and 113 formed of ceramic sheets in the thickness direction and subsequently sintering the same, and a shape and dimensions of the ceramic body 110 and the number of the stacked ceramic layers 111, 112, and 113 are not limited to those illustrated in the present exemplary embodiment.

The conductive patterns 121, 122, 123, 124, 125, and 126 are formed by printing a conductive paste including a conductive metal to have a predetermined thickness on each of the ceramic layers 111, 112, and 113.

For example, the conductive patterns 121, 122, 123, 124, 125, and 126 may be formed of a material including silver (Ag) or copper (Cu), or an alloy thereof, but the present disclosure is not limited thereto.

A total number of the stacked ceramic layers 111, 112, and 113 having the conductive patterns 121, 122, 123, 124, 125, and 126 formed thereon may be variously determined in consideration of electrical characteristics such as an inductance value, or the like, required for the designed laminated inductor 100.

Also, in the present exemplary embodiment, the conductive patterns 121, 122, 123, 124, 125, and 126 may be configured to have a shape corresponding to three-quarters of a loop. However, the present disclosure is not limited thereto and, if necessary, the conductive patterns 121, 122, 123, 124, 125, and 126 may be variously modified to have, for example, a shape corresponding to a half of a loop, a shape corresponding to five-sixths of a loop, or a shape as close to a loop as possible.

In this case, each of the conductive patterns 121, 122, 123, 124, 125, and 126 may include a plurality of unit patterns 121*a*, 122*a*, 123*a*, 124*a*, 125*a*, 126*a*, 121*b*, 122*b*, 123*b*, 124*b*, 125*b*, and 126*b* disposed in parallel to be spaced apart from each other on each of the ceramic layers 111, 112, 113.

Figure 3:
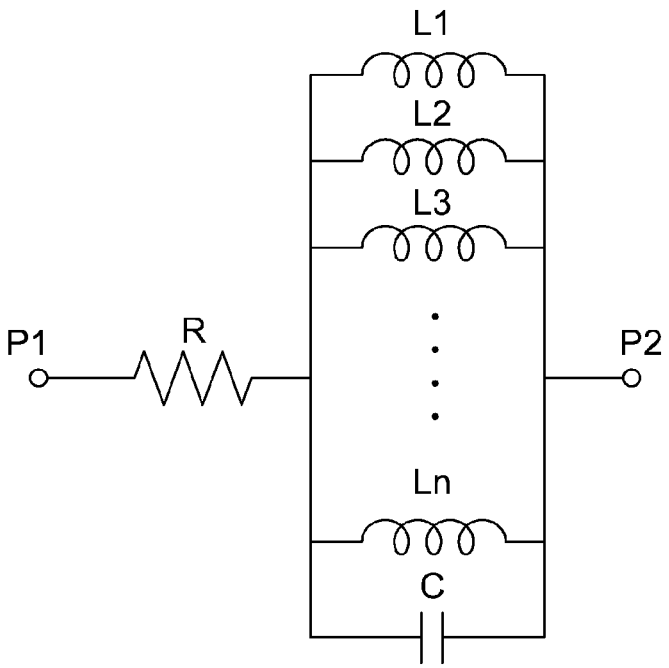
FIG. 3 is a circuit diagram of the laminated inductor according to an exemplary embodiment of the present disclosure.

Referring to FIG. 3, in the present exemplary embodiment, the conductive patterns 121, 122, 123, 124, 125, and 126 each including a plurality of unit patterns are formed on each ceramic layer, and the respective unit patterns are connected to the conductive patterns disposed thereabove and therebelow without discordance (or discrepancy) to implement an inductor having two or more different inductances disposed in parallel within the single ceramic body 110, and through this parallelization, inductance and quality (Q) factor of the inductor in the same core area may be enhanced.

The present exemplary embodiment illustrates that each of the conductive patterns 121, 122, 123, 124, 125, and 126 includes a pair of unit patterns, but the present disclosure is not limited thereto and each of the conductive patterns 121, 122, 123, 124, 125, and 126 may include three or more unit patterns as needed.

Figure 4A:
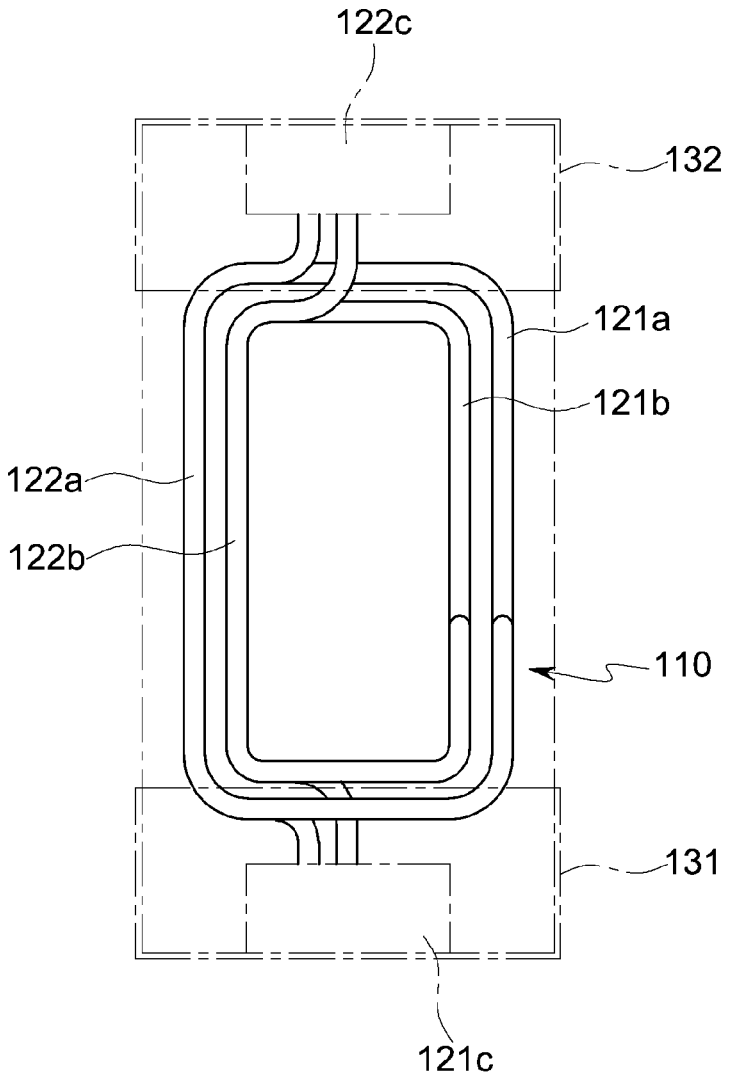
FIGS. 4A and 4B are plan perspective views illustrating examples of lead portions of the laminated inductor according to an exemplary embodiment of the present disclosure.

Referring to FIG. 4A, at least two of the conductive patterns may be configured as the first and second connection patterns 121 and 122 having lead portions 121*c* and 122*c* led out through both end surfaces of the body 110.

The lead portions 121*c* and 122*c* may be in contact with the first and second external electrodes 131 and 132 formed on both end surfaces of the body 110 to be electrically connected thereto.

Figure 4B:
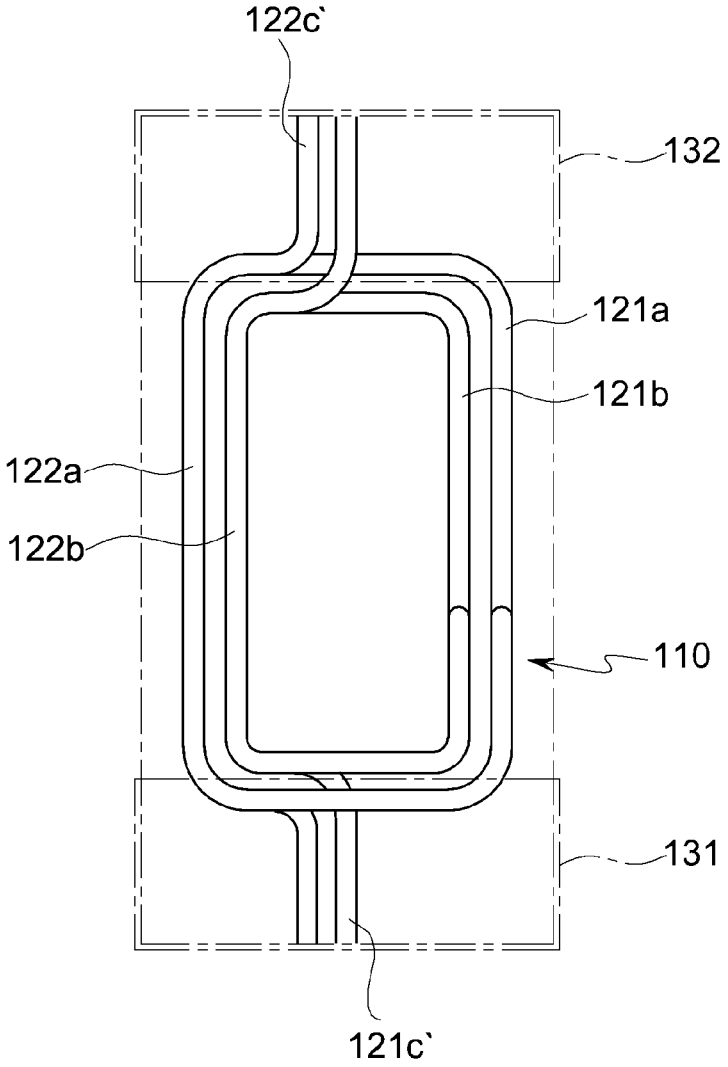

FIG. 4A illustrates a configuration in which a pair of coils are integrated in the conductive patterns, but the present disclosure is not limited thereto. The lead portions refer to portions led out through both end surfaces of the body 110 and may be variously modified. Namely, as illustrated in FIG. 4B, the lead portions 121*c*' and 122*c*' may be implemented as several conductive patterns divided in the same manner as that of the internal coils.

Also, in the present exemplary embodiment, the first and second connection patterns 121 and 122 are disposed upper and lower ends of the body 110, but the present disclosure is not limited thereto.

The via electrodes 140 are disposed between the ceramic layers 111, 112, and 113, respectively, and connect the conductive patterns 121, 122, 123, 124, 125, and 126 to form a coil.

The via electrodes 140 may be formed by forming through holes (not shown) in the ceramic layers 111, 121, and 113 and then filling the through holes with a conductive paste having excellent electrical conductivity.

Also, the conductive paste may be formed of, for example, at least one of silver (Ag), silver-palladium (Ag—Pd), nickel (Ni), and copper (Cu), or an alloy thereof, but the present disclosure is not limited thereto.

The first and second external electrodes 131 and 132 may be formed on both end surfaces of the body 110, and may be in contact with both ends of the coil, namely, the lead portions 121*c* and 122*c* of the first and second connection patterns 121 and 122 led to the outside, to be electrically connected thereto.

The first and second external electrodes 131 and 132 may be formed of a conductive metal having excellent electrical conductivity.

For example, the first and second external electrodes 131 and 132 may be formed of a material including at least one of silver (Ag) and copper (Cu), or an alloy thereof, but the present disclosure is not limited thereto.

Also, nickel (Ni) layers (not shown) may be formed on outer surfaces of the first and second external electrodes 131 and 132 and then, tin (Sn) layers (not shown) may be formed on the nickel (Ni) layers, as plated layers, as needed.

Meanwhile, according to the related art laminated inductor, a single conductive pattern is formed on a single ceramic layer, and correspondingly formed conductive patterns are connected to one another in a vertical direction to form a coil structure, and portions of the coil may be exposed through both ends thereof to be mounted outwardly.

In this case, an internal ceramic area of the coil is called a core, and such a core is proportional to inductance of the laminated inductor.

On the other hand, in the laminated inductor according to the present exemplary embodiment, the conductive patterns including two unit patterns are disposed in parallel to be spaced apart from each other.

In this case, the sum of widths of the two unit patterns and an interval therebetween may be equal to a line width of a singularly formed conductive pattern of the related art laminated inductor. Namely, core areas of the both laminated inductors are identical to each other.

Figure 5:
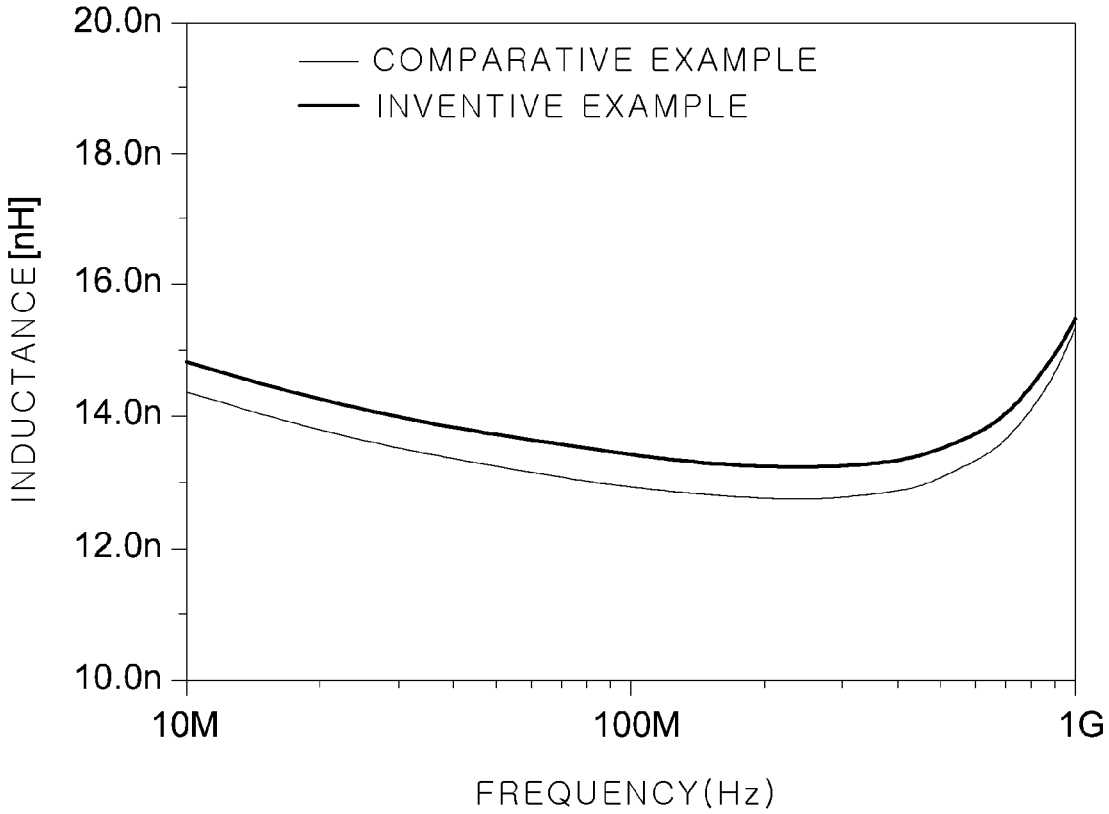
FIG. 5 is a graph illustrating a comparison between inductance of a related art laminated inductor and inductance of the laminated inductor according to an exemplary embodiment of the present disclosure.
Figure 6:
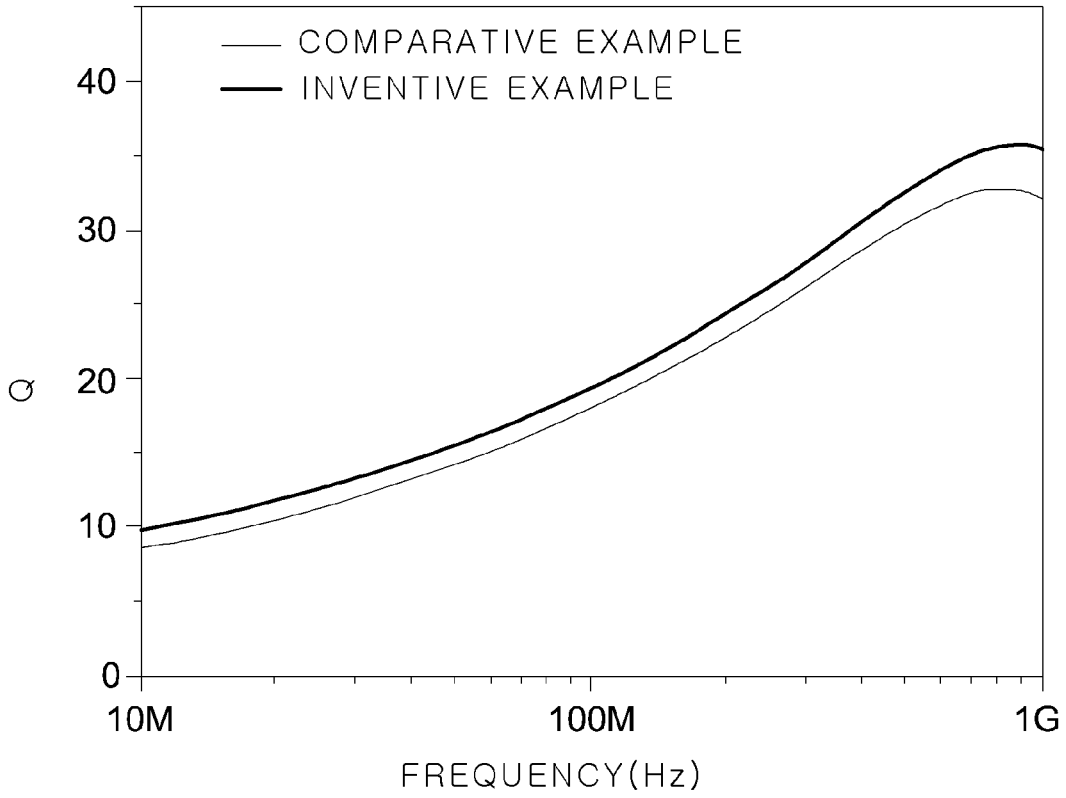
FIG. 6 is a graph illustrating a comparison between Q factor of the related art laminated inductor and Q factor of the laminated inductor according to an exemplary embodiment of the present disclosure.
Figure 7:
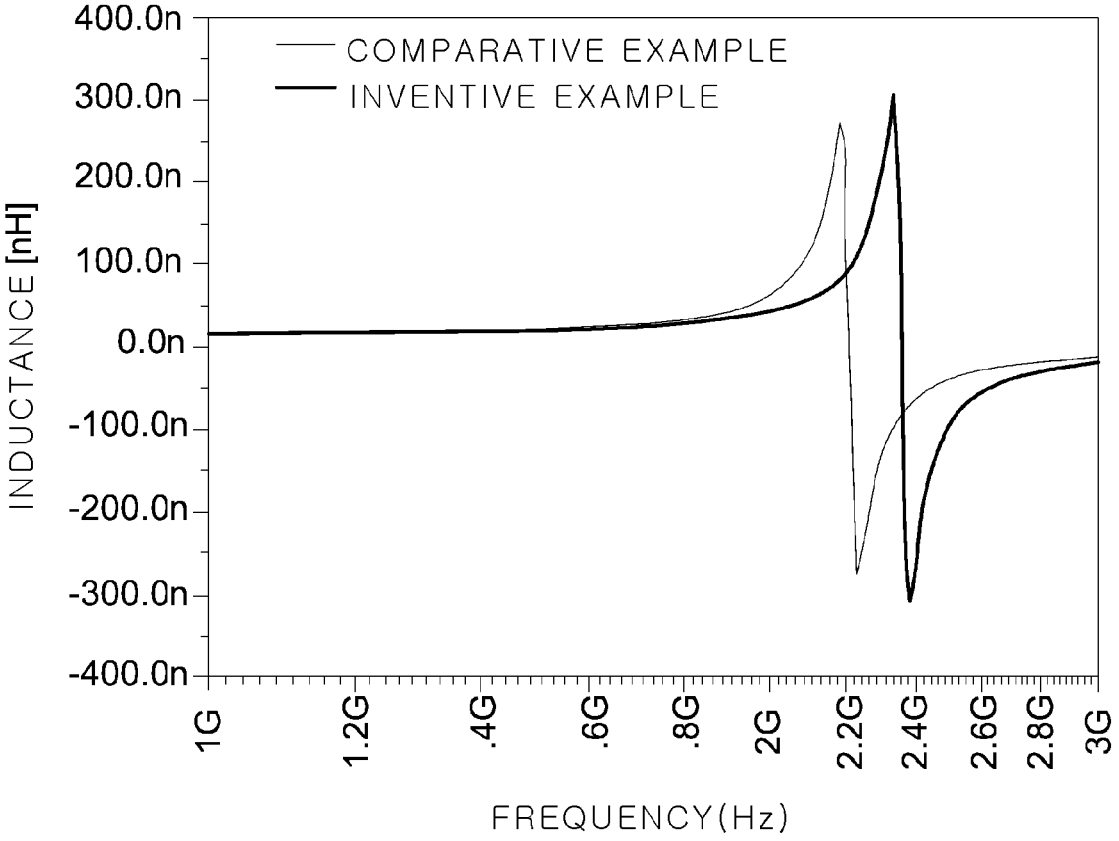
FIG. 7 is a graph illustrating a comparison between inductance and a position of self-resonating frequency (SRF) in a high frequency of the related art laminated inductor and inductance and a position of self-resonating frequency (SRF) in a high frequency of the laminated inductor according to an exemplary embodiment of the present disclosure.

FIG. 5 is a graph illustrating a comparison between inductance of a related art laminated inductor and inductance of the laminated inductor according to an exemplary embodiment of the present disclosure, FIG. 6 is a graph illustrating a comparison between Q factor of the related art laminated inductor and Q factor of the laminated inductor according to an exemplary embodiment of the present disclosure, and FIG. 7 is a graph illustrating a comparison between inductance and a position of self-resonating frequency (SRF) in a high frequency of the related art laminated inductor and inductance and a position of self-resonating frequency (SRF) in a high frequency of the laminated inductor according to an exemplary embodiment of the present disclosure.

Referring to FIGS. 5 through 7, it can be seen that, as compared to Comparative Example, Inventive Example of the present disclosure had inductance higher by approximately 4%, quality factor higher by approximately 8% to 10%, and SRF higher by approximately 150 MHz based on 100 MHz as a reference.

Also, it can be seen that such effects are increased as a frequency is increased.

Namely, when an inductor is implemented such that conductive patterns each including a plurality of unit patterns are formed on single ceramic layers to have two or more different inductances disposed in parallel with each other within a single ceramic body, inductance may be additionally increased and high Q factor and excellent SRF may be implemented, thereby obtaining effects such as a reduction in the number of layers of the laminated inductor or enhancement of a degree of freedom in design according to a space layout.

Hereinafter, a method of manufacturing a laminated inductor according to an exemplary embodiment of the present disclosure will be described.

First, a plurality of ceramic sheets formed of a material such as a magnetic material, a dielectric material, or the like, are prepared.

The number of the stacked ceramic sheets may not be limited, and the total number of the stacked ceramic sheets may be determined according to purposes of the laminated inductor.

Next, conductive via electrodes are formed in each of the ceramic sheets manufactured as above.

The via electrodes may be formed by forming through holes in the ceramic sheets and subsequently filling the through holes with a conductive paste. Alternatively, if necessary, during a process of forming conductive patterns later, the via electrodes may be formed by filling through holes with s conductive paste simultaneously when the conductive patterns are formed.

The conductive paste may be formed of a material having excellent electrical conductivity. For example, the conductive paste may include at least one of silver (Ag), silver-palladium (Ag—Pd), nickel (Ni), and copper (Cu), or an alloy thereof, but the present disclosure is not limited thereto.

Thereafter, conductive patterns are formed on each of the ceramic sheets.

Here, each of the conductive patterns may include a plurality of unit patterns disposed in parallel to be spaced apart from each other on a single ceramic sheet.

The conductive patterns may be formed of a material having excellent electrical conductivity, for example, a conductive material such as silver (Ag), copper (Cu), or an alloy thereof, but the present disclosure is not limited thereto.

In this case, the conductive patterns may be formed by using one of methods, for example, printing, coating, depositing, exposing, thin film plating, and the like, but the present disclosure is not limited thereto.

However, in order to uniformly maintain line widths of respective unit patterns formed on a single ceramic sheet, preferably, the conductive patterns may be formed through the thin film plating method, an exposure of a photosensitive paste, or a printing method of a conductive paste.

The conductive patterns may have various shapes as necessary. For example, the conductive patterns may have a shape corresponding three-quarters of the loop. Also, the conductive patterns may be variously modified to have, for example, a shape corresponding to a half of the loop, a shape corresponding to five-sixths of the loop, or a shape as close to the loop as possible.

Also, at least two of the conductive patterns may be configured as the first and second connection patterns having lead portions led out to both end surfaces of the ceramic body.

Next, in order to allow the via electrodes of the conductive patterns disposed in the vertical direction to come into contact with one another to thereby form a single coil, the ceramic sheets are stacked and pressurized to form a laminate.

In this case, at least one upper or lower cover sheet is stacked on an upper or lower surface of the laminate, or an upper or lower cover layer may be formed by printing a paste formed of a material identical to that of the ceramic sheets constituting the laminate to have a predetermined thickness.

Thereafter, the laminate is sintered to form a body.

Thereafter, first and second external electrodes may be formed on both end surfaces of the body to be electrically connected to first and second connection patterns exposed to both end surfaces of the body.

The first and second external electrodes may be formed of a material having excellent electrical conductivity. For example, the first and second external electrodes may be formed of a conductive material such as silver (Ag) or copper (Cu), or an alloy thereof, but the present disclosure is not limited thereto.

Also, if necessary, the surfaces of the first and second external electrodes formed above may be plated with nickel (Ni) or tin (Sn) to form plated layers.

In this case, the first and second external electrodes may be formed through a general method. For example, the first and second external electrodes may be formed by using one of methods such as a thick film printing method, a coating method, a depositing method, a sputtering method, but the present disclosure is not limited thereto.

As set forth above, according to exemplary embodiments of the present disclosure, an inductor having two or more different inductances disposed in parallel within a single body may be implemented by forming conductive patterns each including a plurality of unit patterns on single ceramic layers. Thus, through the parallelization, the inductance, quality factor, and SRF of the inductor may be enhanced in the same core area, and thus, the number of layers of the laminated inductor may be reduced or a degree of freedom in design according to a space layout may be enhanced.

While exemplary embodiments have been shown and described above, it will be apparent to those skilled in the art that modifications and variations could be made without departing from the spirit and scope of the present disclosure as defined by the appended claims.

What is claimed is:

1. A laminated inductor comprising:

a body having a plurality of ceramic layers stacked in the body;

six conductive patterns disposed on the ceramic layers; and via electrodes disposed on the ceramic layers and connecting the conductive patterns disposed in a vertical direction to form a coil, wherein each of the conductive patterns includes a plurality of unit patterns disposed in parallel to be spaced apart from each other on each of the ceramic layers, and wherein two conductive patterns among the six conductive patterns have shapes corresponding to three-quarters of a loop, two other conductive patterns among the six conductive patterns have shapes corresponding to five-sixths of the loop, and two remaining conductive patterns among the six conductive patterns have shapes corresponding to a half of the loop.

2. The laminated inductor of claim 1, wherein the conductive patterns include first and second connection patterns led out to both end surfaces of the ceramic body.

3. The laminated inductor of claim 2, further comprising: first and second external electrodes disposed on both end surfaces of the body and connected to the first and second connection patterns, respectively.

4. The laminated inductor of claim 1, further comprising: upper and lower cover layers stacked on upper and lower portions of the body.

* * * * *